US006684957B2

(12) United States Patent
Allamon

(10) Patent No.: US 6,684,957 B2
(45) Date of Patent: Feb. 3, 2004

(54) FLOAT COLLAR

(75) Inventor: Jerry P. Allamon, Montgomery, TX (US)

(73) Assignee: Allamon Interests, Montgomery, TX (US)

( * ) Notice: Subject to any disclaimer, the term of this patent is extended or adjusted under 35 U.S.C. 154(b) by 0 days.

(21) Appl. No.: 09/951,828

(22) Filed: Sep. 11, 2001

(65) Prior Publication Data

US 2003/0047314 A1 Mar. 13, 2003

(51) Int. Cl.[7] ..... E21B 34/06
(52) U.S. Cl. ..... 166/332.8; 166/327
(58) Field of Search ..... 166/242.8, 156, 166/154, 194, 222, 327, 328, 334.4, 332.8, 386

(56) References Cited

U.S. PATENT DOCUMENTS 3,645,495 A * 2/1972 Aymar ..... 251/129
3,995,692 A * 12/1976 Seitz ..... 166/318
4,469,174 A * 9/1984 Freeman ..... 166/202
4,615,394 A * 10/1986 Kuhlman, Jr. ..... 166/327
4,729,432 A * 3/1988 Helms ..... 166/317
5,246,069 A * 9/1993 Glaser et al. ..... 166/156
6,209,663 B1 * 4/2001 Hosie ..... 175/57
6,244,342 B1 * 6/2001 Sullaway et al. ..... 166/285
6,401,824 B1 * 6/2002 Musselwhite et al. ..... 166/327

* cited by examiner

*Primary Examiner*—Frank Tsay
(74) *Attorney, Agent, or Firm*—O'Neil & McConnell, PLLC; R. Perry McConnell

(57) ABSTRACT

The present invention relates to a float collar apparatus for regulating the passage of fluid through a casing liner or sub-sea casing. Apparatus of the present invention is fabricated using plastic flapper valves and sleeve components in contrast to prior art float collar components which are fabricated almost entirely of hard metals. The use of plastic components in the float collar apparatus of the present invention provides a substantial reduction in time and resources expended during drilling out of the float collar once cementing operations are completed. Additionally, the float collar apparatus of the present invention is fabricated from a pre-determined combination of plastic components and metal components thereby ensuring that the improved float collar can still endure substantial hydrostatic stresses encountered during casing liner running in and cementing operations.

36 Claims, 3 Drawing Sheets

FLOAT COLLAR

BACKGROUND OF THE INVENTION

1. Field of the Invention

The present invention relates to apparatus for use in the oil industry, and, more particularly, to a float collar apparatus for use in oil well drilling operations.

2. Description of the Prior Art

Float collars are utilized by the oil well industry with respect to operations for running in and cementing casing liners down a wellbore. An example of a prior art float collar is the Multi-Purpose Float Collar manufactured and sold by Davis-Lynch, Inc. The Multi-Purpose Float Collar comprises a tubular housing having a bore therethrough and two spring-activated flapper valves which are held in an open position by a sliding sleeve installed in the bore of the float collar. Once the sleeve is forced out of the bore of the float collar, the spring-activated flapper valves are free to rotate to their closed positions.

In practice, a float collar, such as the Multi-Purpose Float Collar of Davis-Lynch, Inc., is installed within the lower end of a casing liner prior to running the casing liner down a wellbore. When the spring-activated flapper valves of the float collar are held in an open position by the sliding sleeve, a clear passage is provided through the casing liner. This open position permits drilling fluid to flow freely through the float collar as the casing liner is being run downhole, which helps to reduce surge pressure against the borehole walls and permits the casing liner to be more readily lowered to total depth. Additionally, if a tight hole condition is encountered during running in of the casing liner, drilling fluid can be pumped downward through the casing liner to circulate drilling fluid around the tight hole condition thereby freeing the casing liner.

Once the casing liner is lowered to total depth, the sliding sleeve is of the float collar actuated using a drop ball, which seats in a ball seat which is coupled to the sliding sleeve. The sliding sleeve is held in place by shear pins installed in the lower portion of the sleeve. Pressure is then increased above the drop ball until the shear pins shear, at which time the sleeve is displaced axially out of the float collar. This movement of the sleeve frees the spring-activated flapper valves to rotate to a closed position. In the closed position, the flowpath through the casing is obstructed such that any fluid passing through the casing must overcome the resistance the spring-activated flapper valves to establish communication between the lower end of the casing liner and the annulus between the casing liner and the borehole.

During cementing operations, cement is pumped downward through the casing at sufficiently high pressure to overcome the resistance of the spring-activated flapper valves. Once cement pumping operations cease, the spring-activated flapper valves close and seal the passage through the casing. This prevents the cement from flowing back upward into the casing. This effect is also known in the art as "backflow" or "u-tube" action. Finally, once cementing operations are completed, the entire float collar assembly is drilled out of the casing to reestablish an unobstructed flowpath through the wellbore.

While prior art float collars have produced desirable results for the oil well industry, a feature of prior art float collars which is undesirable is that once cementing operations are complete, prior art float collars require approximately six hours to drill out of the casing liner to reestablish the unobstructed flowpath. This relatively long drill out time is due in large part to the high metal content of components of the float collar. Prior art float collars are fabricated almost entirely of metals, e.g. aluminum. While the use of such metals allows the float collar assembly to be set at pressures up to 3000 psi, the metal components of the float collar assembly become a disadvantage when cementing operations are completed and valuable time and resources must be expended during drilling out the float collar.

Accordingly, it would be desirable to have a float collar which can be drilled out in substantially less time than the prior art float collars. This novel and useful result has been achieved by the present invention.

SUMMARY OF THE OF THE INVENTION

Apparatus in accordance with the present invention comprises a float collar assembly for regulating the passage of fluid through a tubular member. The float collar assembly is positioned within the tubular member cased in cement at the lower end of the tubular member. The float collar assembly comprises an outer housing having an axial bore therethrough and one or more spring-activated flapper valves arranged within the housing. The spring-activated flapper valves are actuated by an internal sleeve which is fabricated from plastic and which is initially held inside the housing by a plurality of shear pins extending into corresponding shear pin recesses formed near the upper end of the sleeve. While the sleeve is located in the housing, the spring-activated flapper valves are secured by the sleeve in an open position. A drop ball seat is integral with the plastic sleeve and is located at the bottom of the sleeve. The seat receives a drop ball thereby creating a seal which blocks fluid flow through the tubular member. Subsequently, fluid pressure is increased above the drop ball seat such that the shear pins are sheared and the internal sleeve is displaced downward from the float collar assembly thereby freeing the spring-activated flapper valves to rotate to a closed position. In the closed position, the spring-activated flapper valves obstruct passage through the tubular member.

While components of prior art float collars are fabricated almost entirely from metal, the float collar apparatus of the present invention is fabricated from a combination of metal and plastic components. This resultant float collar assembly provides a savings in time and resources expended during drilling out of the float collar.

DETAILED DESCRIPTION OF SPECIFIC EMBODIMENTS

A description of certain embodiments of the present invention is provided to facilitate an understanding of the invention. This description is intended to be illustrative and not limiting of the present invention. The preferred embodiment of the float collar of the present invention will be described with respect to oil well casing installation operations. However, it is intended that the present invention may be utilized with any tubular member being run in and cemented to a wellbore.

Figure 1:
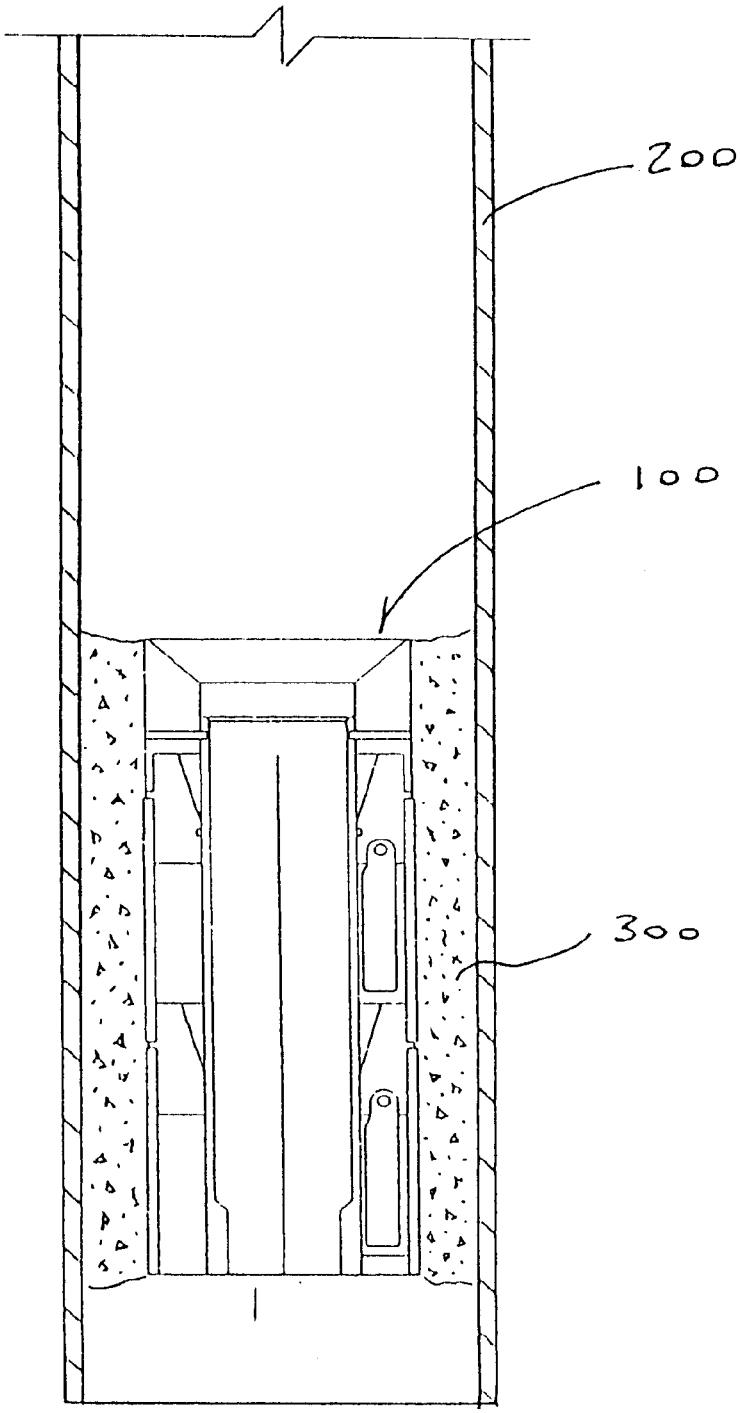
FIG. 1 is a profile view of a float collar in accordance with the present invention for regulating the position of spring-activated flapper valves in an oil well casing liner.

With reference to FIG. 1, apparatus in accordance with the present invention comprises a float collar assembly 100 encased in cement 300 at the lower end of tubular member 200. Tubular member 200 may be a casing liner or sub-sea casing, however, it is intended that the present invention may be utilized with any tubular member being run in and cemented to a well bore.

Figure 3:
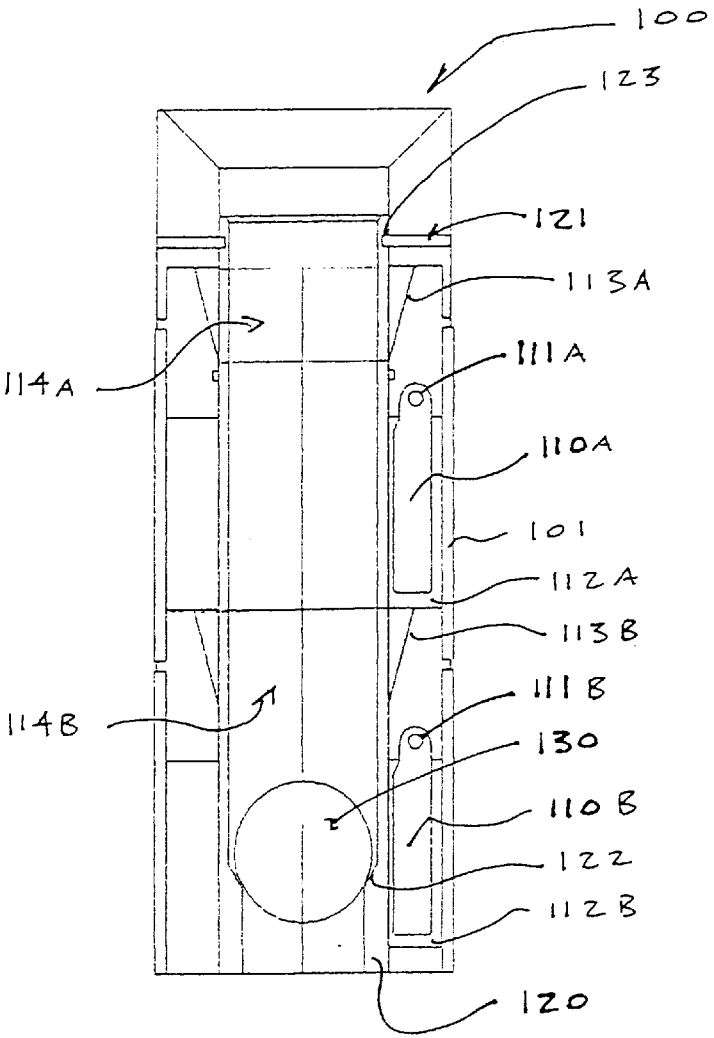
FIG. 3 is an enlarged section view of a float collar in accordance with the present invention with drop ball lodged in seat of actuating sleeve.
Figure 2:
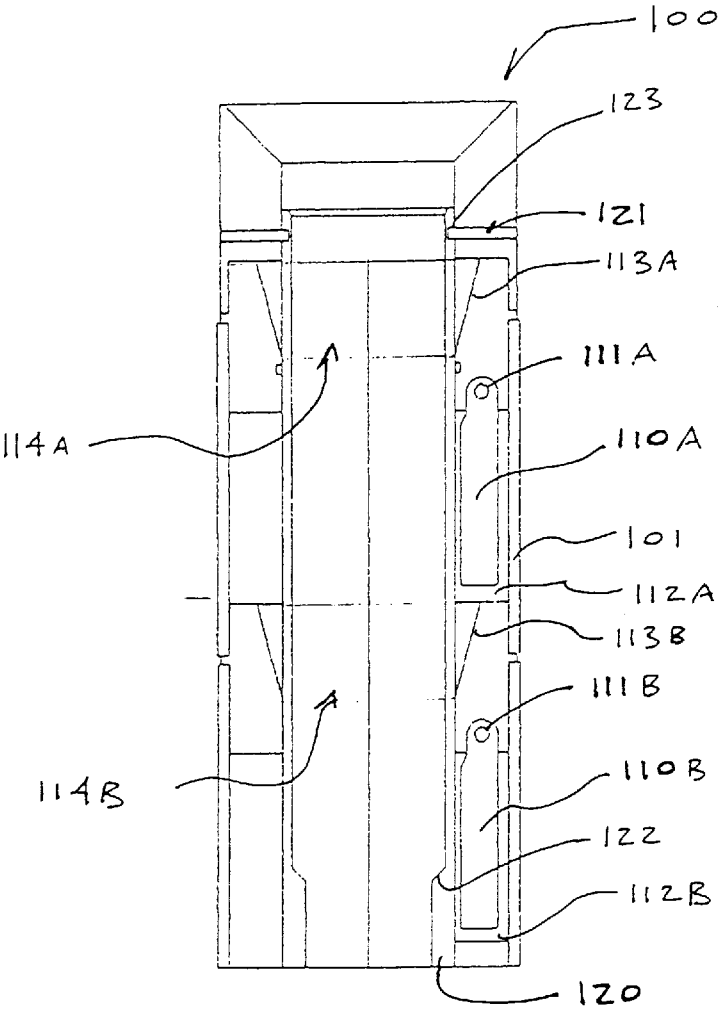
FIG. 2 is an enlarged section view of a float collar in accordance with the present invention with actuating sleeve in place securing spring-activated flapper valves in an open position.

With reference to FIG. 2, the float collar assembly 100 of the present invention comprises a housing 101, two flapper valve assemblies 114A, 114B, and a valve actuating sleeve 120. Each flapper valve assembly 114A, 114B comprises a flapper 110A, 110B, a flapper recess 112A, 112B, a pin and spring 111A, 111B, and a frustoconical valve body 113A, 113B. The valve actuating sleeve 120 comprises a drop ball seat 122 being integral with the inner surface of the sleeve and having an axial bore therethrough for receiving drop ball 130 (FIG. 3). The diameter of drop ball 130 (FIG. 3) is less than or equal to diameter of valve actuating sleeve 120, but greater than diameter of axial bore of drop ball seat 122. Additionally, the sleeve 120 comprises a plurality of pin recesses 123 for receiving a plurality of shear pins 121. The pin recesses 123 are formed along the outer surface and near the upper end of the sleeve 120.

The float collar assembly of the present invention comprises components that are each fabricated from materials such that the float collar assembly can endure high stresses typical of a running in and cementing operation, but can also be drilled out of the casing liner in a shorter period of time than that of prior art float collars. The flapper valve assemblies 114A, and 114B and the valve actuating sleeve 120 and seat 122 are fabricated from a modified nylon blend material. Particularly, the modified nylon blend components of a preferred embodiment of the present invention are fabricated from Vekton 6XAU, manufactured by Ensinger, Inc. Vektron 6XAU is a cast type 6 nylon having enhanced heat-resistant, weather-resistant, and bearing properties.

While a preferred embodiment of the present invention comprises components which are fabricated from a modified nylon blend, it is intended that these components may be fabricated from any plastic material having thermal-resistant, bearing and fatigue characteristics that are sufficient to endure high stresses involved in running in and cementing operations, but that will yield at a lower stress than metal components during drill out operations.

In a preferred embodiment, housing 101 may be fabricated from any hard metal having bearing and wear characteristics that are sufficient to endure high stresses involved in running in and cementing operations.

Thus, a preferred embodiment of the float collar of the present invention comprises a float collar assembly comprising a combination of modified nylon blend components and aluminum components such that the float collar assembly can withstand a maximum stress of approximately 600 psi and be drilled out of the casing liner in approximately two hours.

Still with reference to FIG. 2, in operation, the float collar apparatus of the present invention is installed within the lower end of casing liner 200 (FIG. 1) with valve actuating sleeve 120 restraining flappers 110A, 110B of flapper valve assemblies 114A, 114B in an open position against tension of flapper springs 111A, 111B. The valve actuating sleeve 120 is restrained from axial displacement by the shear pins 121 installed in pin recesses 123 of valve actuating sleeve. This creates an open flowpath through which drilling fluid can pass unobstructed through axial bore of housing 101.

With reference to FIG. 3, once casing liner 200 (FIG. 1) is lowered to total depth of wellbore (not shown), a drop ball 130 is dropped through the casing liner and upper end of housing 101 into drop ball seat 122. The drop ball 130 seals with drop ball seat 122 thereby obstructing the flowpath of drilling fluid through the casing liner 200 (FIG. 1).

Figure 4:
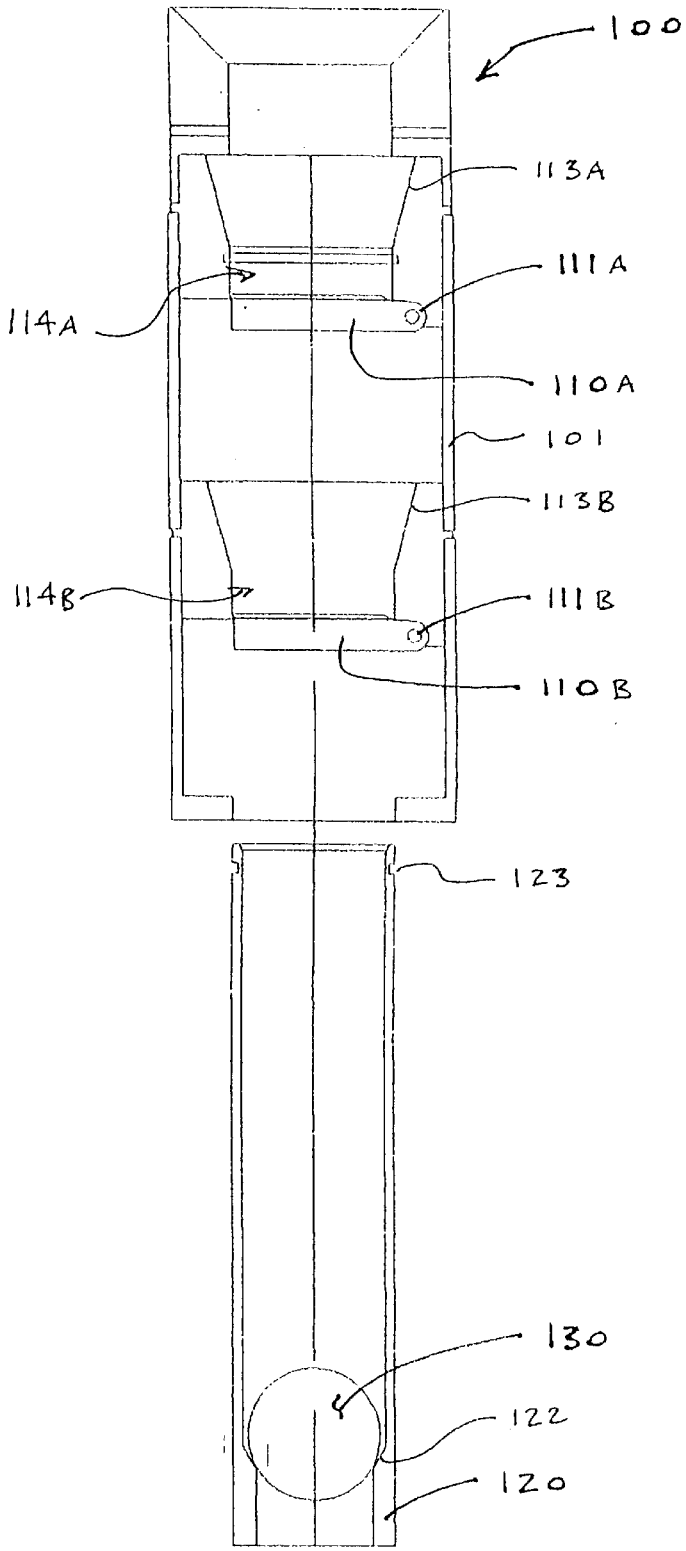
FIG. 4 is an enlarged section view of a float collar in accordance with the present invention with actuating sleeve displaced downward from float collar housing and spring-activated flapper valves rotated to closed position.

Next, with reference to FIG. 4, drilling fluid pressure is increased above drop ball 130 and drop ball seat 122 to a predetermined level such that pins 121 shear. With pins 121 sheared, valve 30 actuating sleeve 120 is free to displace axially downward out of housing 101 to the bottom of the borehole. Once valve actuating sleeve 120 is displaced from housing 101, flappers 110A, 110B of flapper valve assemblies 114A, 114B are forced by spring 111A, 111B to rotate about flapper pins 111A, 111B into engagement with frustoconical valve bodies 113A, 113B. Cementing operations may now be commenced.

During cementing of the casing liner 200 (FIG. 1) to the borehole, cement is pumped downward through the casing liner, out of the axial bore of housing 101, and upward into the annulus between the borehole and the casing liner. To pass the closed flappers 110A, 110B of flapper valve assemblies 114A, 114B, the hydrostatic pressure of the cement is increased to overcome the resistance of the springs 111A, 111B of the flappers. Once the predetermined quantity of cement is deployed and the hydrostatic pressure is reduced, the springs 111A, 111B of flapper valve assemblies 114A, 114B force the flappers 110A, 110B upwards to engage the frustoconical valve bodies 113A, 113B. This once again obstructs the flow path through the housing 101 and prevents the cement from traveling back into the casing liner 200 (FIG. 1).

Finally, once cementing operations are completed, the components of float collar assembly 100 are drilled out to provide an open flowpath to the bottom of the borehole. While prior art full metal float collars typically require about six hours to drill out, the non-metal components of the float collar of the present invention are more yielding to drill out operations and reduce drill out time to approximately two hours.

What is claimed is:

1. Float collar apparatus comprising:

a tubular housing having an axial bore with a predetermined diameter therethrough, said housing being fabricated from metal, at least one flapper valve arranged within the housing having an open position where the axial bore through the housing is unobstructed by the flapper valve and a closed position where the axial bore through the housing is obstructed by the flapper valve, said flapper valve being fabricated from a hardened plastic material, and a sleeve being fabricated from a hardened plastic material, said sleeve comprising: (i) an outer surface having a diameter less than or equal to the diameter of the axial bore through the housing; (ii) an inner surface having a seat integrally formed thereon, said seat having an axial bore therethrough with a diameter less than the diameter of the inner surface of the sleeve; and (iii) a connecting means for attaching the sleeve to the housing thereby preventing the flapper valve from shifting to the closed positions wherein said hardened plastic materials of said flapper valve and said sleeve can withstand operational conditions within a wellbore for the duration of run in and cementing operations.

2. The apparatus of claim 1, wherein the connecting means for attaching the sleeve to the housing is one or more shearable pins, each of said pins extending into a pin recess formed into the outer surface and near the upper end of the sleeve.

3. The apparatus of claim 1, wherein said metal is aluminum.

4. The apparatus of claim 1, wherein said hardened plastic material of said flapper valve comprises a cast nylon.

5. The apparatus of claim 1, wherein said non-metallic material is a hardened plastic material.

6. The apparatus of claim 1, wherein said hardened plastic material of said sleeve comprises a cast nylon.

7. The apparatus of claim 1, wherein said hardened plastic material of said flapper valve comprises a nylon blend.

8. The apparatus of claim 1, wherein said hardened plastic material of said sleeve comprises a nylon blend.

9. The apparatus of claim 1, wherein said hardened plastic material of said flapper valve comprises type 6 nylon.

10. The apparatus of claim 1, wherein said hardened plastic material of said sleeve comprises type 6 nylon.

11. A system for regulating drilling fluid and cement flow through a tubular member being run in and cemented to a wellbore, said system comprising:

a metal housing being fixed within the tubular member and positioned near the lower end of the tubular member, said housing having an axial bore therethrough such as to provide a conduit for drilling fluid and cement to pass from within the tubular member downward into the wellbore, at least one plastic flapper valve arranged within the housing having an open position where drilling fluid may flow through the housing, and a closed position where the valve permits cement to flow downward from the tubular member into the wellbore, but not upward from the wellbore into the casing liner, a plastic sleeve arranged within the housing and having a drop ball seat with an axial bore therethrough integrally formed therein, said sleeve being movable from a fixed position where shear pins positioned near the top of the sleeve prevent the sleeve from sliding thereby holding the valves in the open position, to a displaced position where the sleeve is displaced axially downward out of the housing to permit the valves to move to the closed position, and a drop ball having a diameter greater than the diameter of the axial bore through the drop ball seat of the plastic sleeve but less than or equal to the inner diameter of the sleeve, said drop ball being released into the housing and sealing with the drop ball seat such that said displacement of the sleeve occurs when drilling fluid pressure is increased above the drop ball to a predetermined level to shear the shear pins, wherein said plastic materials of said flapper valve and said sleeve comprise plastics which can withstand operational conditions within a wellbore for the duration of run in and cementing operations.

12. The system of claim 11, wherein the tubular member is a casing liner or sub-sea casing.

13. The system of claim 11, wherein said metal is aluminum.

14. The system of claim 11, wherein said plastic material of said flapper valve comprises a cast nylon.

15. The system of claim 11, wherein said non-metal sleeve is fabricated from plastic and said non-metal flapper valve is fabricated from plastic.

16. The system of claim 11, wherein said plastic material of said sleeve comprises a cast nylon.

17. The system of claim 11, wherein said plastic material of said flapper valve comprises a nylon blend.

18. The system of claim 11, wherein said plastic material of said sleeve comprises a nylon blend.

19. The system of claim 11, wherein said plastic material of said flapper valve comprises type 6 nylon.

20. The system of claim 11, wherein said plastic material of said sleeve comprises type 6 nylon.

21. A float collar for regulating drilling fluid and cement flow, comprising:

a tubular body having an interior;

a sleeve, positionable within said interior of said tubular body and releasably connectable to said tubular body; and a normally closed valve, comprising a plastic material which can withstand operational conditions within a wellbore for the duration of run in and cementing operations, wherein said valve is held open by said sleeve when said sleeve is positioned within and connected to said tubular body.

22. The float collar of said sleeve comprises a plastic material which can withstand operational conditions within a wellbore for the duration of run in and cementing operations.

23. The float collar of claim 22, wherein said plastic material comprises cast nylon.

24. The float collar of claim 19, wherein said plastic material comprises a nylon blend.

25. The float collar of claim 22, wherein said plastic material comprises type 6 nylon.

26. The float collar of claim 21, wherein said plastic material comprises cast nylon.

27. The float collar of claim 21, wherein said plastic material comprises a nylon blend.

28. The float collar of claim 21, wherein said plastic material comprises type 6 nylon.

29. A float collar for regulating drilling fluid and cement flow, comprising:

a tubular body having an interior;

a sleeve, comprising a plastic material which can withstand operational conditions within a wellbore for the duration of run in and cementing operations, positionable within said interior of said tubular body and releasably connectable to said tubular body; and a normally closed valve, wherein said valve is held open by said sleeve when said sleeve is positioned within and connected to said tubular body.

30. The float collar of claim 29, wherein said valve comprises a plastic material which can withstand operational conditions within a wellbore for the duration of run in and cementing operations.

31. The float collar of claim 30, wherein said plastic material comprises cast nylon.

32. The float collar of claim 30, wherein said plastic material comprises a nylon blend.

33. The float collar of claim 30, wherein said plastic material comprises type 6 nylon.

34. The float collar of claim 29, wherein said plastic material comprises cast nylon.

35. The float collar of claim 29, wherein said plastic material comprises a nylon blend.

36. The float collar of claim 29, wherein said plastic material comprises type 6 nylon.

* * * * *